US005654541A

United States Patent [19]

Outlaw et al.

[11] Patent Number: 5,654,541

[45] Date of Patent: Aug. 5, 1997

[54] SMALL VACUUM COMPATIBLE HYPERTHERMAL ATOM GENERATOR

[75] Inventors: Ronald A. Outlaw, Newport News, Va.; Mark R. Davidson, Florahome, Fla.

[73] Assignee: The United States of America as represented by the United States National Aeronautics and Space Administration, Washington, D.C.

[21] Appl. No.: 356,741

[22] Filed: Nov. 21, 1994

Related U.S. Application Data

[63] Continuation-in-part of Ser. No. 88,963, Jul. 2, 1993, Pat. No. 5,367,161.

[51] Int. Cl.[6] ..... H05H 3/00

[52] U.S. Cl. ..... 250/251

[58] Field of Search ..... 250/251, 427

[56] References Cited

U.S. PATENT DOCUMENTS

| | | | |
|---|---|---|---|
| 4,542,010 | 9/1985 | Roman et al. | 423/579 |
| 4,599,157 | 7/1986 | Suzuki et al. | 204/192 SP |
| 4,686,022 | 8/1987 | Rempt | 250/298 |
| 4,828,817 | 5/1989 | Outlaw et al. | 250/251 |
| 5,367,161 | 11/1994 | Outlaw et al. | 250/251 |

*Primary Examiner*—Bruce C. Anderson
*Attorney, Agent, or Firm*—George F. Helfrich

[57] ABSTRACT

A vacuum compatible hyperthermal atom generator includes a membrane having two sides, the membrane having the capability of dissolving atoms into the membrane's bulk. A first housing is furnished in operative association with the first side of the membrane to provide for the exposure of the first side of the membrane to a gas species. A second housing is furnished in operative association with the second side of the membrane to provide a vacuum environment having a pressure of less than $1\times10^{-3}$ Torr on the second side of the membrane. Exciting means excites atoms adsorbed on the second side of the membrane to a non-binding state so that a portion from 0% to 100% of atoms adsorbed on the second side of the membrane are released from the second side of the membrane primarily as an atom beam.

5 Claims, 12 Drawing Sheets

AP, IE=0 modes

SMALL VACUUM COMPATIBLE HYPERTHERMAL ATOM GENERATOR

CROSS-REFERENCE

This application is a continuation in part application of Ser. No. 08/088,963, Filed Jul. 2, 1993, now U.S. Pat. No. 5,367,161, granted Nov. 22, 1994.

ORIGIN OF THE INVENTION

The invention described herein was made jointly by an employee of the United States Government and a non-government employee and may be used by or for the Government for governmental purposes without the payment of any royalties thereon or therefor.

BACKGROUND OF THE INVENTION

1. Technical Field of the Invention

This invention relates generally to the dissociation of molecules into atoms, their transport through a solid membrane and their subsequent desorption by electron or photon desorption. In particular, it relates to a device for the production of a high purity, neutral hyperthermal atomic beam generator capable of producing e.g. atomic oxygen, nitrogen, hydrogen, and other species, the device being compact and ultrahigh vacuum (UHV), high vacuum, and rough vacuum ($<10^{-3}$ Torr) compatible.

2. Description of Related Art

The composition of the atmosphere within the orbital envelope (200– 1000 km) combined with the orbital velocity (8 km $s^{-1}$) results in a flux of hyperthermal atomic oxygen (E~5 eV, v~$10^{15}$ $cm^{-2}s^{-1}$) impinging on spacecraft surfaces. The extreme reactivity of atomic oxygen leads to numerous chemical unions with other species to form, for example, CO, $CO_2$, $H_2O$, $O_2$, $SO_2$, and $NO_2$. Further, the high chemical reactivity of this O atom flux has caused substantial degradation of organic materials on board the Shuttle and suggests that materials on the proposed Space Station Freedom, the composites used in large space structures, exterior coatings on the optics of the Hubble Space Telescope, the UV telescopes, and future laser communications systems may have substantially reduced lifetimes. It is therefore essential to study the reactivity of these materials to atomic oxygen in ground based laboratories. In order to conduct such laboratory experiments, an atomic oxygen beam generator is required that can accurately simulate the flux and energy (within the appropriate vacuum environment) of the vehicle experience in orbit. In addition to oxygen atom reactions that the vehicle experiences in orbit, and to oxygen atom reactions with spacecraft materials, such a beam system as well as other atomic beam sources would also be of importance in the calibration of mass spectrometers and other detection systems that would be used for mapping the density of gas constituents within the orbital envelope. Such calibration is essential to make accurate measurements of the representative gas environment within the orbital envelope. A pure, well behaved O beam would also be useful for producing an ordered oxide layer for growth of compound semiconductors and superconductors. Methods of thin film growth, such as molecular beam epitaxy (MBE), could fully utilize a directed O atom beam to grow desired layers without the residual contaminating effects of backfield $O_2$ or the limitations of dissociative adsorption as well as N and H beams for producing high purity nitrides and hydrides. In addition, atomic halogen beams could be used to etch semiconductor and other materials in a uniform, well controlled manner. Other areas of interest, such as fundamental surface science and chemical kinetics, are obvious. It is also possible to generate beams of molecular particles with the present invention although the primary use for the present invention is the production of single atom particles. For simplicity, the term atom beam, when applied to the present invention, is assumed to include the whatever particle is desired from the source even if the desired particles are molecules. There are several systems that are presently available for the above applications, but they are, in general, quite large, expensive, not ultrahigh vacuum (UHV) compatible, and require the samples to be brought to their location.

In U.S. Pat. No. 4,828,817 a process for generating a pure atomic oxygen beam was disclosed, which process obviated many of the disadvantages associated with the systems of the prior art. Still lacking, however, was a simple workable, practical device that is small and designed for UHV applications.

SUMMARY OF THE INVENTION

It is accordingly the primary object of the present invention to provide what is not available in the prior art, viz., a small, vacuum compatible hyperthermal (energy>0.1 eV) atom generator which is simple, yet eminently practical and workable.

This object and its attending benefits were achieved by the provision of an instrument which combines the mechanisms of $O_2$ dissociation and transport of oxygen atoms through a hot Ag membrane to provide a continuous source of O atoms to a vacuum interface where they are subsequently emitted into the vacuum space by electron stimulated desorption (ESD) or photon stimulated desorption (PSD). A flux of neutral O atoms on the order of $1\times10^{14}$ $cm^{-2}s^{-1}$ ($^3P$) with a kinetic energy of approximately 5 eV and a FWHM of 4 eV generated in UHV is now possible. The geometry of the instrument is such that it is mounted on a 7-cm flange and can be tailored in length and orientation to fit most UHV systems. The data presented here are for ESD-controlled conditions where increases in the flux are strictly linear with electron bombardment current. Transport controlled conditions can be achieved at temperatures as low as 350° C. with membrane thicknesses on the order of 10 μm.

The instrument of the present invention includes a membrane having two sides, the membrane having the capability of dissolving the atoms into its bulk. If no other means of dissociation of the gas species is provided, the membrane must also have the capability of dissociating molecules of the desired gas species into atoms. The gas species includes any precursor molecule or atom which will yield the desired atom beam in the present invention. The membrane material is chosen to allow the dissolution of the atoms and for ESD characteristics e.g. Ag for an O source, Pd for H source, Ta for N source. A means is provided to expose a first side of the membrane to molecules or previously dissociated atomic species, and another means provides a vacuum environment of a pressure of less than $1\times10^{-3}$ Torr on the second side of the membrane. A heater affords a temperature sufficient to promote dissociation of the molecules (if a prior means of dissociating the molecules is not provided) and the subsequent atomic permeation to the second side of the membrane. The heater can include any device or method that raises the temperature of the membrane above ambient temperature e.g. electric resistance heater, electron beam heater, quartz lamp heater. The exciting means (electron or photon source) can also serve as the heater. An exciting means excites the atoms to a non-binding state, resulting in their release from the second side of the membrane as an atomic beam. Optionally, a predissociation means dissociates the source molecules prior to or in conjunction with their adsorption on the first side of the membrane. The predissociation means may consist of any means that yields a higher concentration of dissociated or electronically excited species in the gas phase or on the membrane surface than would be obtained without the predissociation means e.g. glow discharge, RF plasma, photon source, catalytic surfaces, microwave plasma. The exciting means may advantageously consist of a cathode (any source of electrons) as well as a lens system if the geometry of the cathode requires a lens system. The cathode and lens system may be circular or any other shape that accomplishes the bombardment of the membrane surface with electrons. A lens system is any device that affects the trajectories of charged particles. The lens system is primarily for directing the electrons to the surface of the membrane in a generally uniform coverage, but the lens system may also optionally limit the escape of charged species from the source. One possible lens system that would accomplish this purpose consists of one or more grids in the path of the atom beam. The lens system can include electrode surfaces, insulating surfaces, or grids. An electrode surface is any conductive surface that has the capability, when electrically charged, of affecting the trajectories of charged particles. A grid is any mesh constructed of conductive materials that is capable of affecting the trajectories of charged particles when electrically biased.

The exciting means may also include a photon source, either alone or in combination with the cathode and/or lens system. This configuration could also include an optical lens system which is any device that affects the paths of photons.

BRIEF DESCRIPTION OF THE DRAWINGS

For a more complete understanding of the present invention, including its primary object and attending benefits, reference should be made to the Description of the Preferred Embodiments, which is set forth below. This description should be read together with the accompanying drawings, wherein.

DESCRIPTION OF THE PREFERRED EMBODIMENTS

Figure 1:
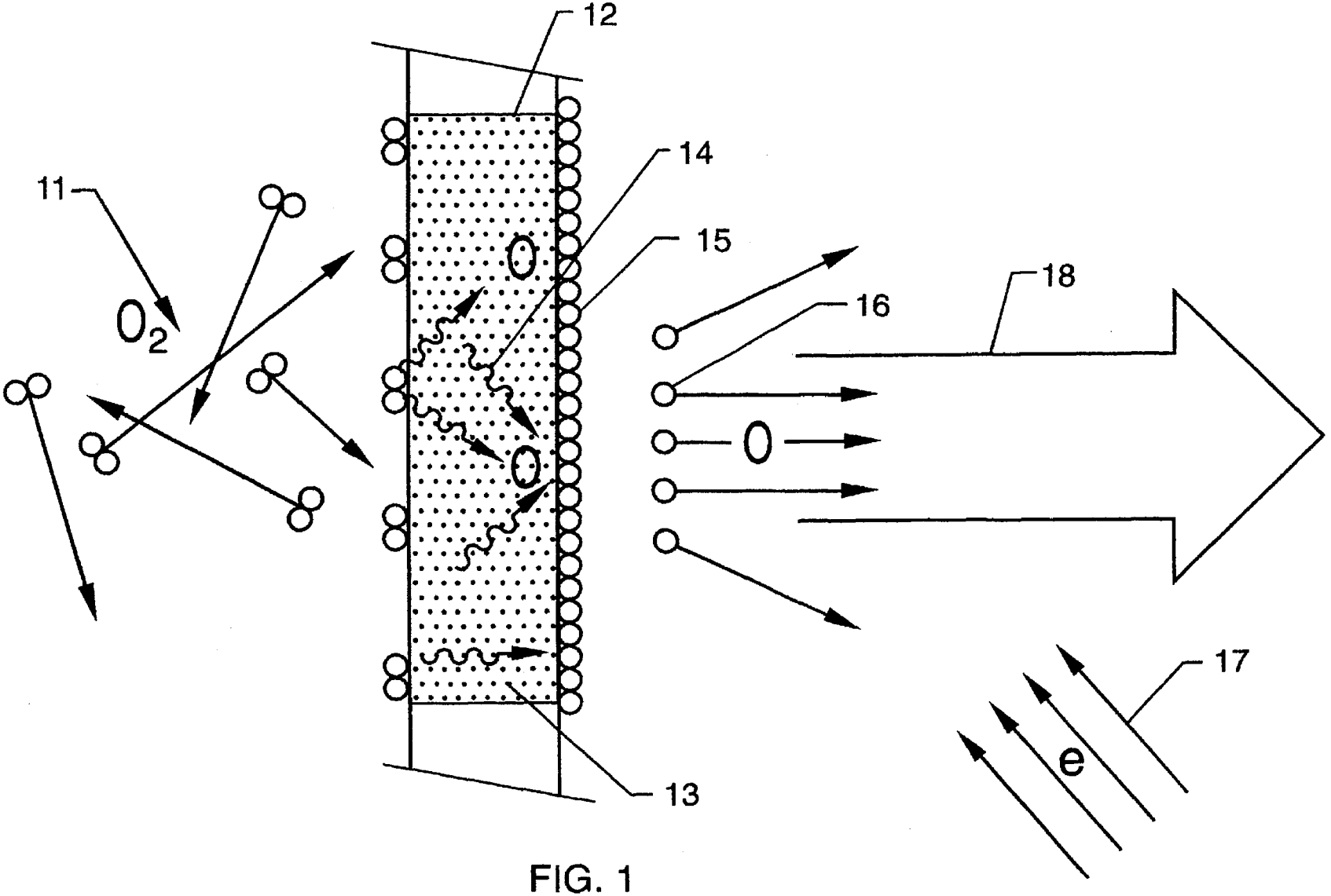
FIG. 1 is a schematic representation of the combined mechanisms of predissociation, transport through a membrane followed by emission of hyperthermal neutrals according to the present invention. A is representative of the atomic species desired e.g. O, N, H, Cl, F.

The hyperthermal atom generator (HAG) of the present invention employs two different mechanisms. The first is the permeability of atoms through solid materials (e.g. O in Ag, O in Yttria stabilized, $ZrO_2$, H in Pd, N in Ta) sequential adsorption of gas molecules (or atoms if a predissociation means is used) surface dissociation into atoms (if necessary), dissolution into the bulk, and diffusion of atoms through a membrane where the atoms emerge at the vacuum interface and enter into atomically bound states at the surface. At sufficiently high temperatures, the atoms which arrive at the vacuum interface have sufficient thermal energy for surface diffusion which ultimately results in recombination and desorption of molecules. Optionally, a means for predissociation 40 may be included to enhance the transport rate. The second mechanism is the utilization of electron-stimulated desorption (ESD) or photon stimulated desorption (PSD). By using an incident flux of electrons or photons, the bound atoms are excited to antibonding states and desorb as neutrals with kinetic energies greater than 0.1 eV (e.g. 5 eV for 0 ESD from Ag). FIG. 1 shows the combination of these two processes schematically. Usually, ESD and PSD are conducted on dosed surfaces where the emission is a function of the decay in surface coverage. Eventually, the coverage becomes so low that redosing is required to continue the study. In the present invention, a continuous source of gas species ($A_x$ where $1<x<8$) 11 is provided (upstream), usually $0.1 \leqq p \leqq 1000$ Torr, to resupply the vacuum interface 12 (downstream) by permeation through a membrane 13, e.g., Ag or Ag alloy of thickness <0.254 mm for an O source, Pd or Pd alloy for H source, Ta or Ta alloy for N source. This, of course, means that the membrane 13 must be operated at a temperature high enough to ensure a sufficient permeability, but yet low enough that the atomic adsorbed state is stable, and molecular species are not formed (downstream) unless it is a beam of molecular species that is desired. The surface coverage of atoms downstream at the vacuum interface 12 is given by $$-\sigma_o \frac{d\theta}{dt} = J_T - J_{ESD} \quad (1)$$

where $\theta$ is the surface coverage $J_T$ is the atom flux through the membrane 13, $J_{ESD}$ is the electron stimulated desorption or photon stimulated desorption of the adsorbed species.

$\sigma_o$ is the monolayer surface concentration.

The limiting mechanism is determined primarily by membrane temperature, thickness, and upstream pressure for the transport and by electron or photon bombardment flux and energy for ESD or PSD.

The original proof of concept of these combined mechanisms was accomplished by charging an Ag wire with 100 Torr of oxygen at 500° C. for one hour to provide a high concentration of oxygen in solid solution. Then, after evacuation to the UHV region, the wire was heated while simultaneously bombarding the surface with 100 eV electrons at a current of 0.5 mA in direct line of sight to the ion source of a quadruple mass spectrometer (QMS). A very clear and unambiguous atomic oxygen peak was observed and found to behave predictably and characteristically on the relevant transport and ESD parameters.

Accordingly, referring again to FIG. 1, the gas species dissociates and diffuses 14 through membrane 13. The dissociation and, consequently, the permeation rate, can be enhanced by the application of a predissociation means 40. Atoms emerge 15 and desorb 16 by electron or photon stimulated desorption 17, resulting in a pure atom beam 18.

Figures 2A, 2B:
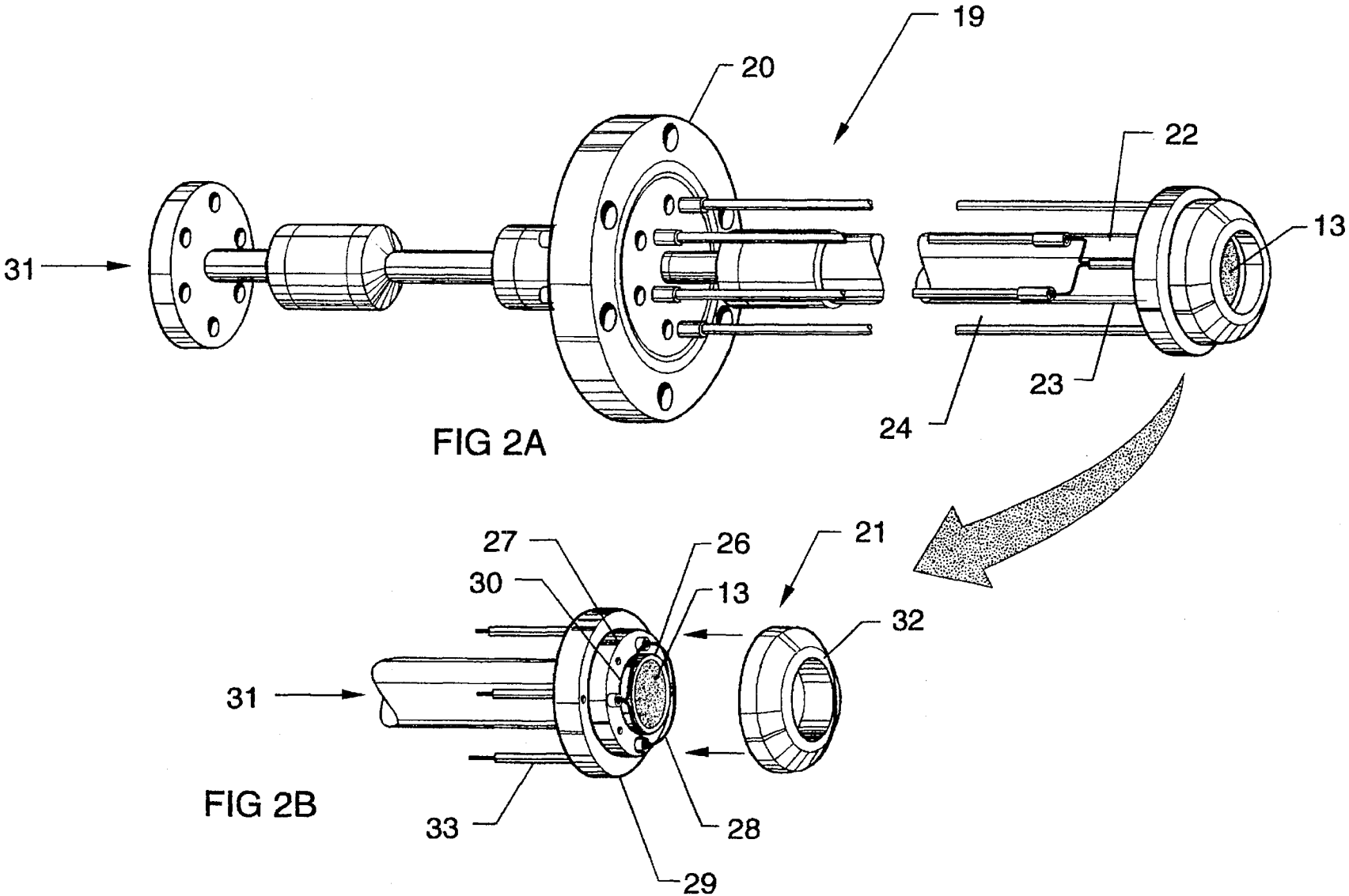
FIG. 2A is a schematic of a device according to the present invention.
FIG. 2B is a detailed inset showing a top hat membrane, a circular cathode, and a reflector of the device of FIG. 2A.

Referring now to FIG. 2A, a device 19 according to the present invention is shown mounted on a 8-pin, 7-cm diameter conflat flange 20. The overall length of the device can be constructed to fit any size (>10 cm) the membrane assemble 21, which is shown in detail in FIG. 2B. Heater 22 includes two concentric layers of 0.025 cm NiCr wire coils mounted on a machinable ceramic (e.g., Macor) mandrel, and provides sufficient heat to adjust membrane 13 to temperatures in excess of 800° C. The heater can also be constructed inside the gas species supply tube to avoid vacuum contamination problems. The optional radiation shield 23 prevents heat up of system chamber 24, and shutter plate 25 minimizes membrane or target contamination prior to procedural clean up and provides an instant turn-on and turn-off capability. Membrane 13 is insulated 26 from flange 27 in order to allow a bias voltage for optimum electron and ion optics. Referring now to FIG. 2B wherein heater 22 is not shown, top hat permeation membrane 13, which is advantageously either silver or a silver alloy form O source, Pd or Pd alloy for H source, and Ta or Ta alloy for N source, is seen in operative association with cathode 28, which is any electron source advantageously a thoriated tungsten or iridium filament of 0.013 cm diameter, which filament is located in a plane that is, depending on the lens system design, operatively higher or lower than the surface of top hat membrane 14. Cathode 28 is concentric with lens system assembly 29, in order to ensure a generally uniform electron bombardment over membrane 13, which will generate a generally uniform atomic oxygen flux from the membrane surface. Cathode 28 is positioned and secured by means of ceramic filament support 30. A continuous source of gas species (11 in FIG. 1) is supplied through conduit 31. Lens 32 is a metallic member which repels electrons emanating from circular cathode 28 so that a reasonably uniform electron bombardment will occur on the surface of membrane 13. A thermocouple assembly is shown at 33.

Figure 2C:
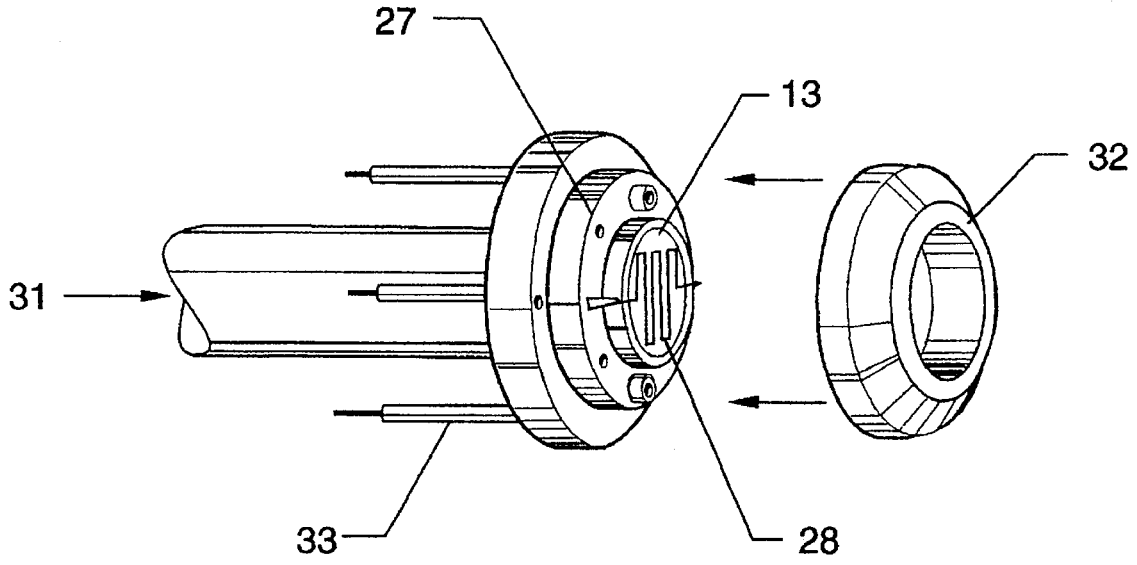
FIG. 2C is a detailed inset showing an example of another possible cathode configuration in which the cathode is placed directly above the membrane surface.
Figure 2D:
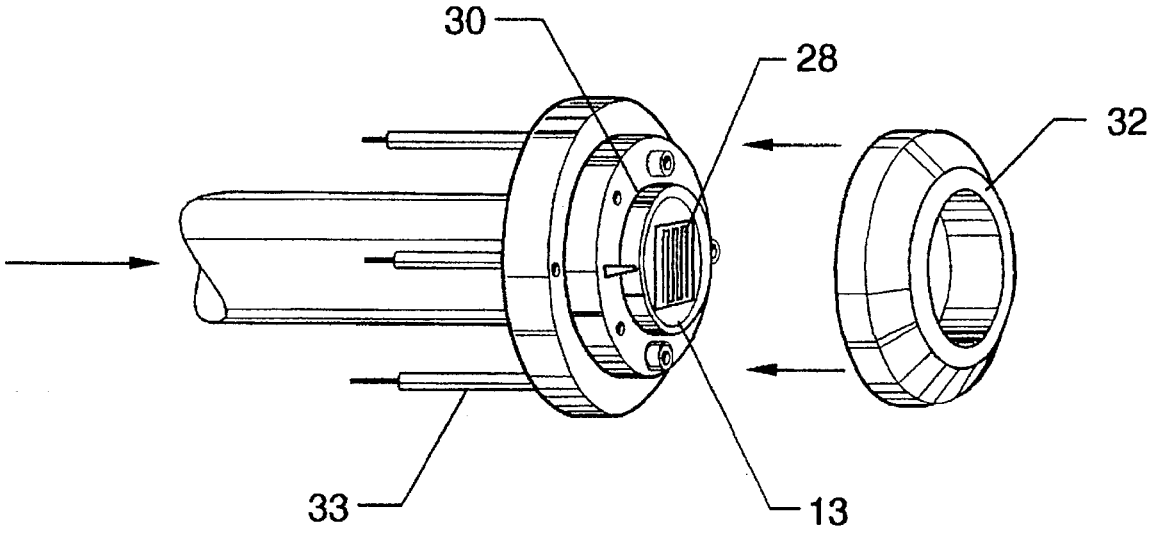
FIG. 2D is an detail inset showing an example of the present invention using a photon source for the exciting means.

FIG. 2C shows another possible cathode configuration that has the cathode directly above the plane of the membrane. This figure shows one of many different cathode lens configurations that yield the reasonable uniformity of electron flux and filtering undesired charged particles from the output atom beam. FIG. 2D shows a configuration of the current invention in which a photon source 37 is the exciting means. The photon source also incorporates an optical lens assembly 38 for focusing or defocusing of the photons and grids 39 for the removal and defocusing of unwanted charged species.

Figure 3A:
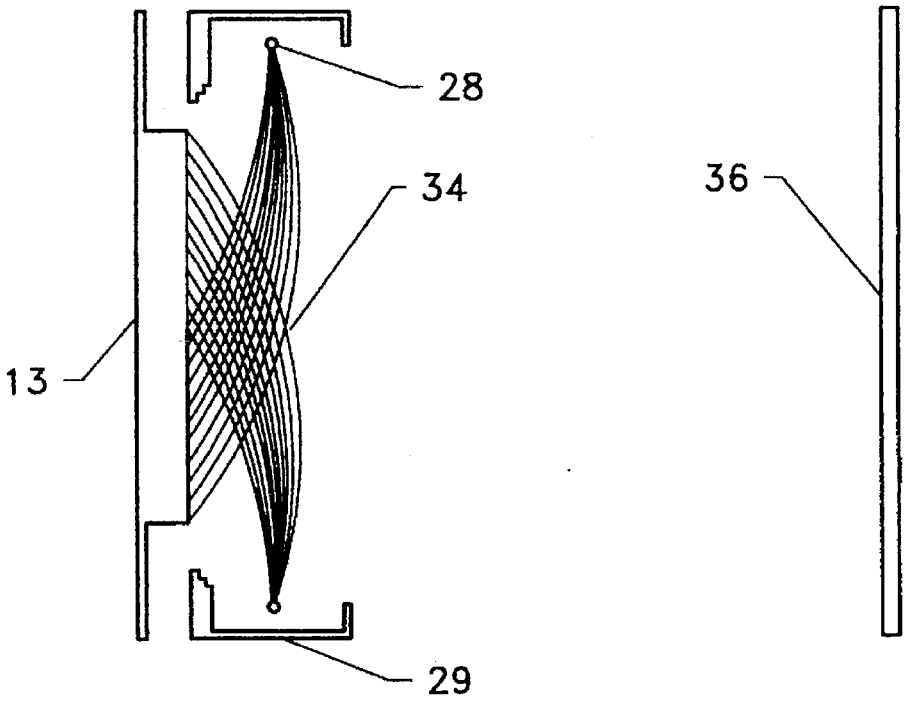
FIG. 3A is a Simion computer simulation of the electron trajectories for another possible cathode/lens assembly configuration.
Figure 3B:
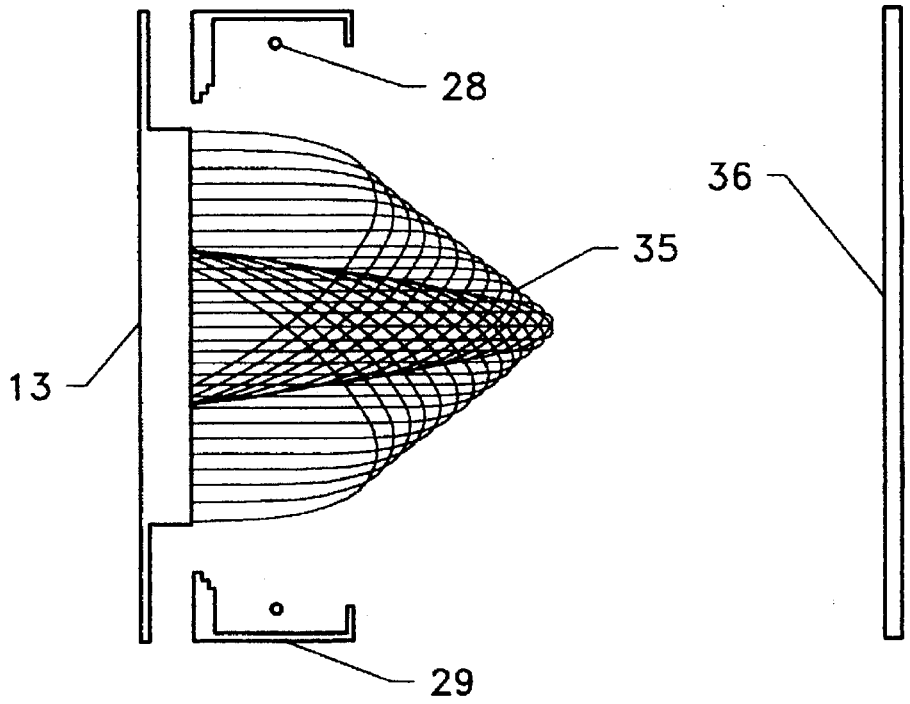
FIG. 3B is a Simion computer simulation showing that highly energetic secondary electrons have trajectories which return to the emission plane showing the ability of this particular lens system to limit the escape of charged species from the source.
Figure 4A:
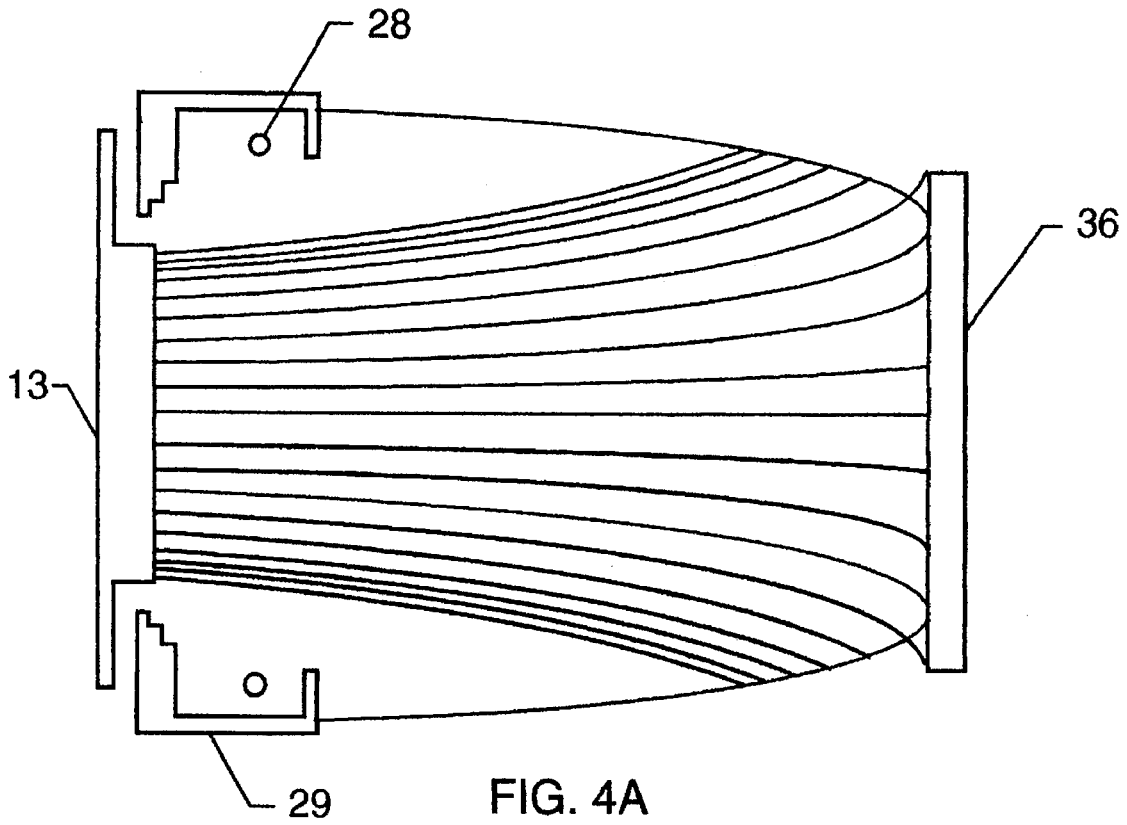
FIG. 4A is a Simion computer simulation of ion trajectories for a sample to target distance of 9 cm.
Figure 4B:
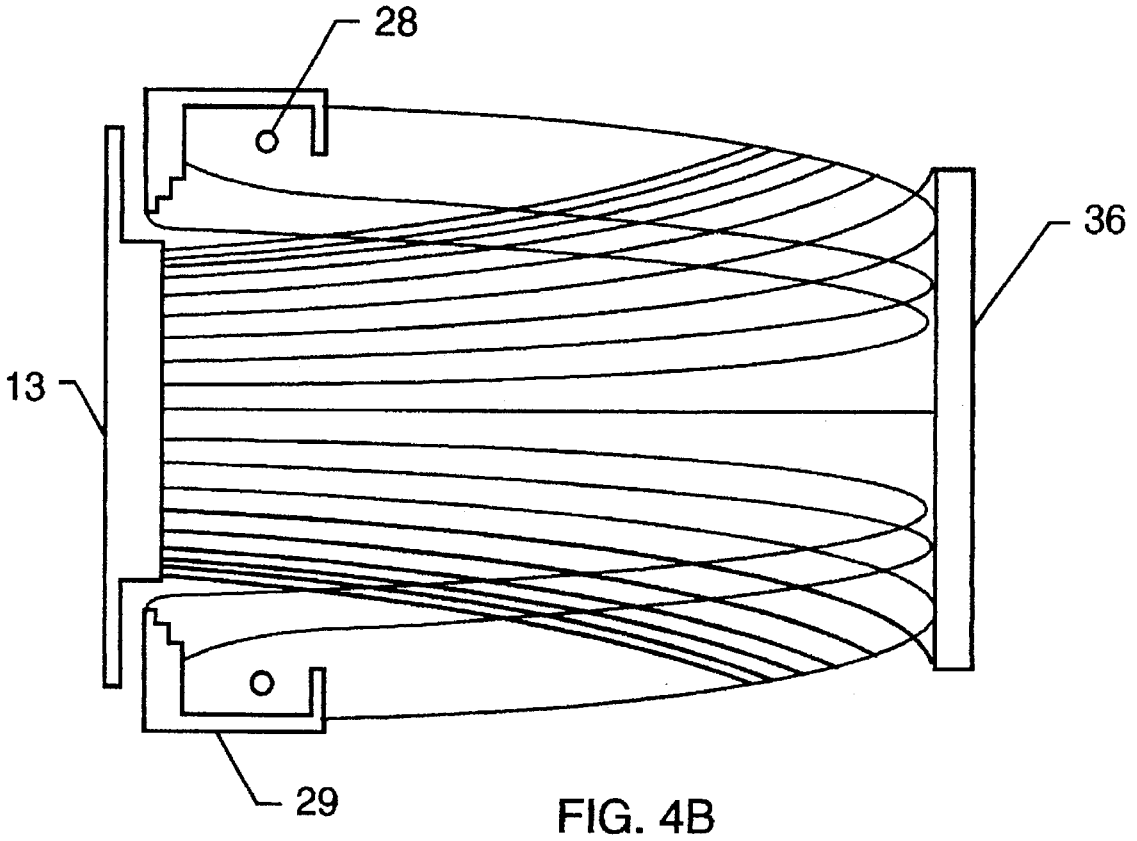
FIG. 4B is a Simion computer simulation showing that when a bias of −80 V is applied, all ions return to the emission plane.

FIG. 3A shows the results of the computer-aided design of electron trajectories 34 using another lens 29/cathode 28 arrangement. When membrane 13 is operated at ground and cathode 28 is operated at −1700 V, the reflector 29 is operated at +50 V with respect to the cathode, which gives the uniform bombardment flux as shown. FIG. 3B shown that even highly energetic secondary electrons (1000 eV) have trajectories 35 which return to the surface of membrane 13 in the potential field shown. Very energetic positive ions (10 eV) which are emitted by ESD in this potential field are, in part, going to reach target 36 located 10 cm away. As is shown in FIG. 4A, the ions emitted in parallel paths near the centerline of membrane 13 (normal to the surface of membrane 13) have sufficient energy to escape the potential field of reflector 29. However, if a bias voltage of −80 V is applied to membrane 13, the maximum excursion away from the membrane is 9 cm, so the ions would not arrive at a target 36 or a sample 10 cm away, thus effectively trapping all ion emission within that distance (see FIG. 4B). Further, this bias does not affect the ESD of neutrals in any significant way. A separate electrode in front of the emission plane to capture all the ions is also an option, but it is desirable to minimize any scattering or recombination surfaces which may alter the emission flux or purity.

Figure 5:
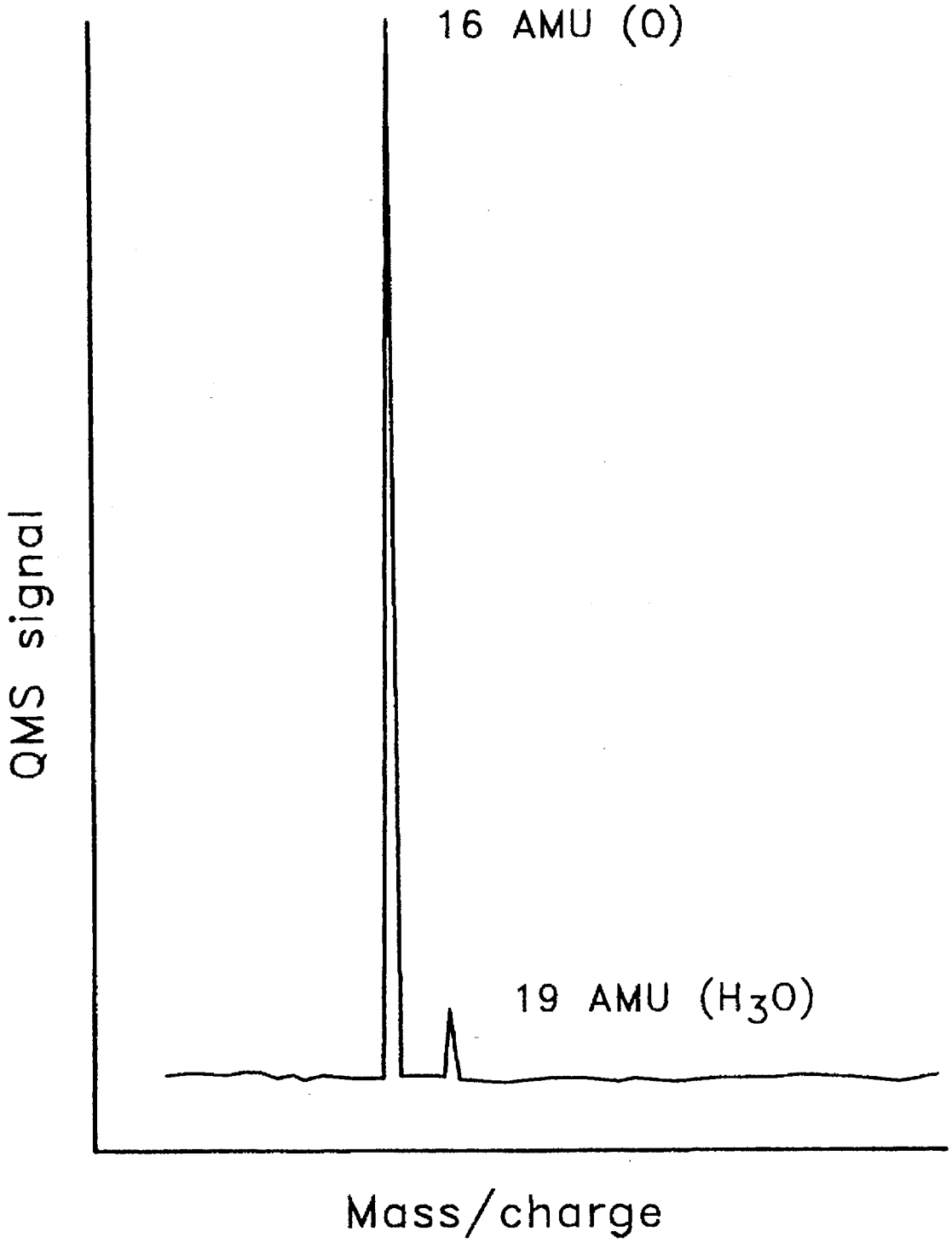
FIG. 5 shows the atomic oxygen signal for a device according to the present invention designed for atomic oxygen production as detected by a quadruple mass spectrometer (QMS)

The spectra of a hyperthermal atom generator according to the present invention, particularly an atomic oxygen generator, as detected by a quadrupole mass spectrometer (QMS) with the ionizer in the appearance potential mode and the extractor voltage at OV, is shown in FIG. 5. The QMS signal due to background gases cuts off at extractor potentials less than 2 V, which indicates that ions with energies less than 2 eV have a negligible probability for transmission through this quadrupole mass filter. At an extractor potential of 0 V, the ESD neutrals are detected, but background signals are not. This indicated that ESD neutrals of 2 eV or greater are detected. Clearly, the predominant peak is atomic oxygen. The continuously diminishing peak at m/e=19, which is most likely $H_3O$ from the QMS ion source, ultimately disappears after sufficient cleanup. The ionized efficiency for this QMS was determined from $$\frac{J_{out}}{J_{in}} = \frac{Sk_BT}{Aev_{in}} \quad (2)$$

where

S is the QMS sensitivity $k_b$ is Boltzmann's constant,

T is the gas temperature,

A is the area of the aperture, e is the electronic charge, and $v_{in}$ is the velocity of the entering particles.

Figure 6:
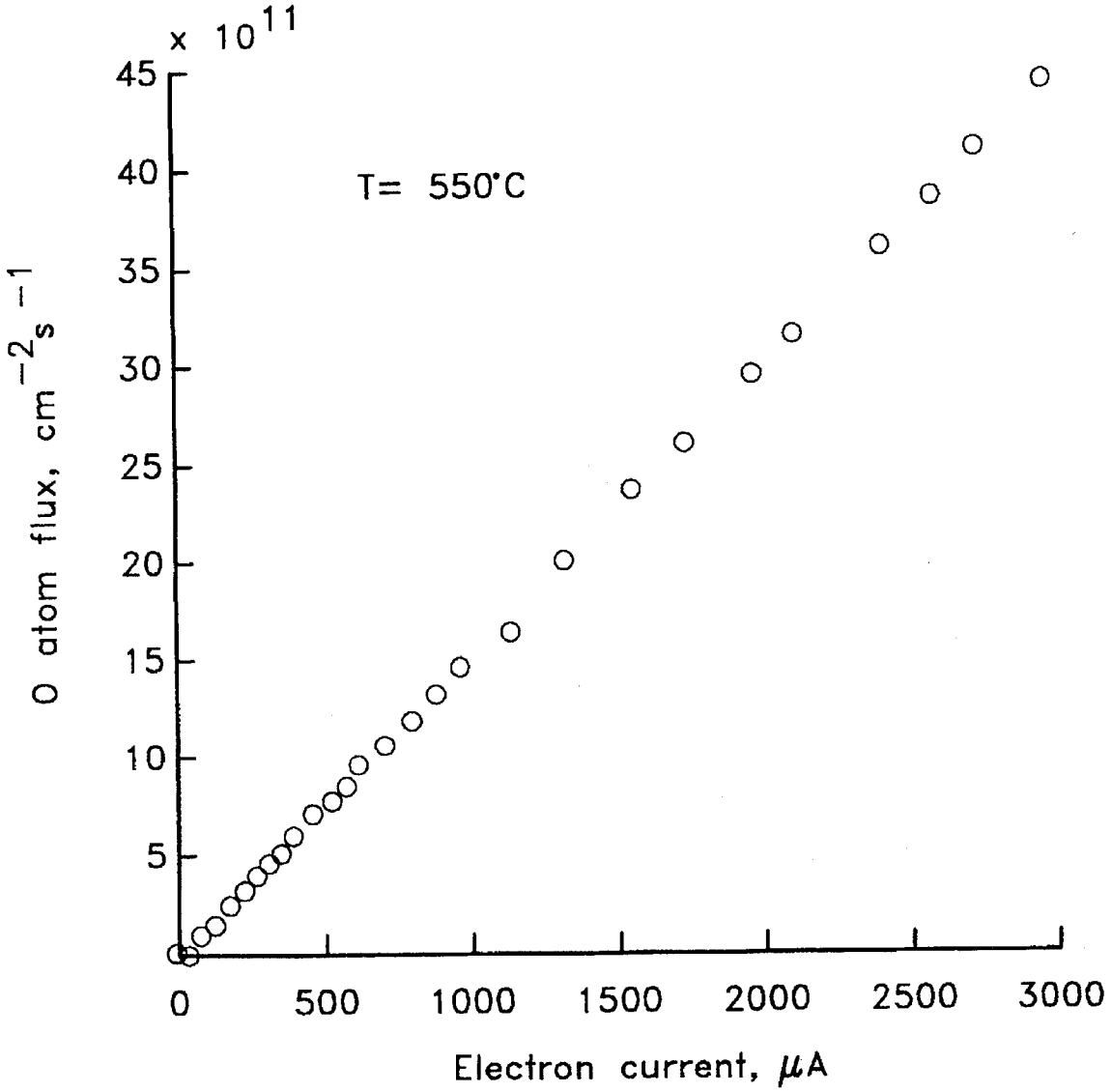
FIG. 6 is a plot of atom flux as a function of electron bombardment current for a device according to the present invention designed for atomic oxygen production.

Equation (2) yields an efficiency of $6.4\times10^{-8}$ ions/atom for an emission current of 0.2 mA. This ionizer sensitivity was used to calculate an 0 neutral/0 ion ratio of $1.6\times10^{7}$. This very high 0 neutral/0 ion ratio may be a result of a dense secondary electron cloud due to the impact of the primaries ($E_e$~1700 eV). The emitted ESD ions then experience a high probability of neutralization. The variation in atomic oxygen flux as a function of incident electron flux is shown in FIG. 6. The linearity seen is consistent with normal ESD behavior and indicates that the hyperthermal oxygen atom generator of this invention is ESD limited in this case. The highest flux achieved so far with the atomic oxygen source is approximately $5\times10^{13}$ $cm^{-2}s^{-1}$ ($I_c$=20 mA) at a distance of 10 cm from the emission plane.

Figure 7:
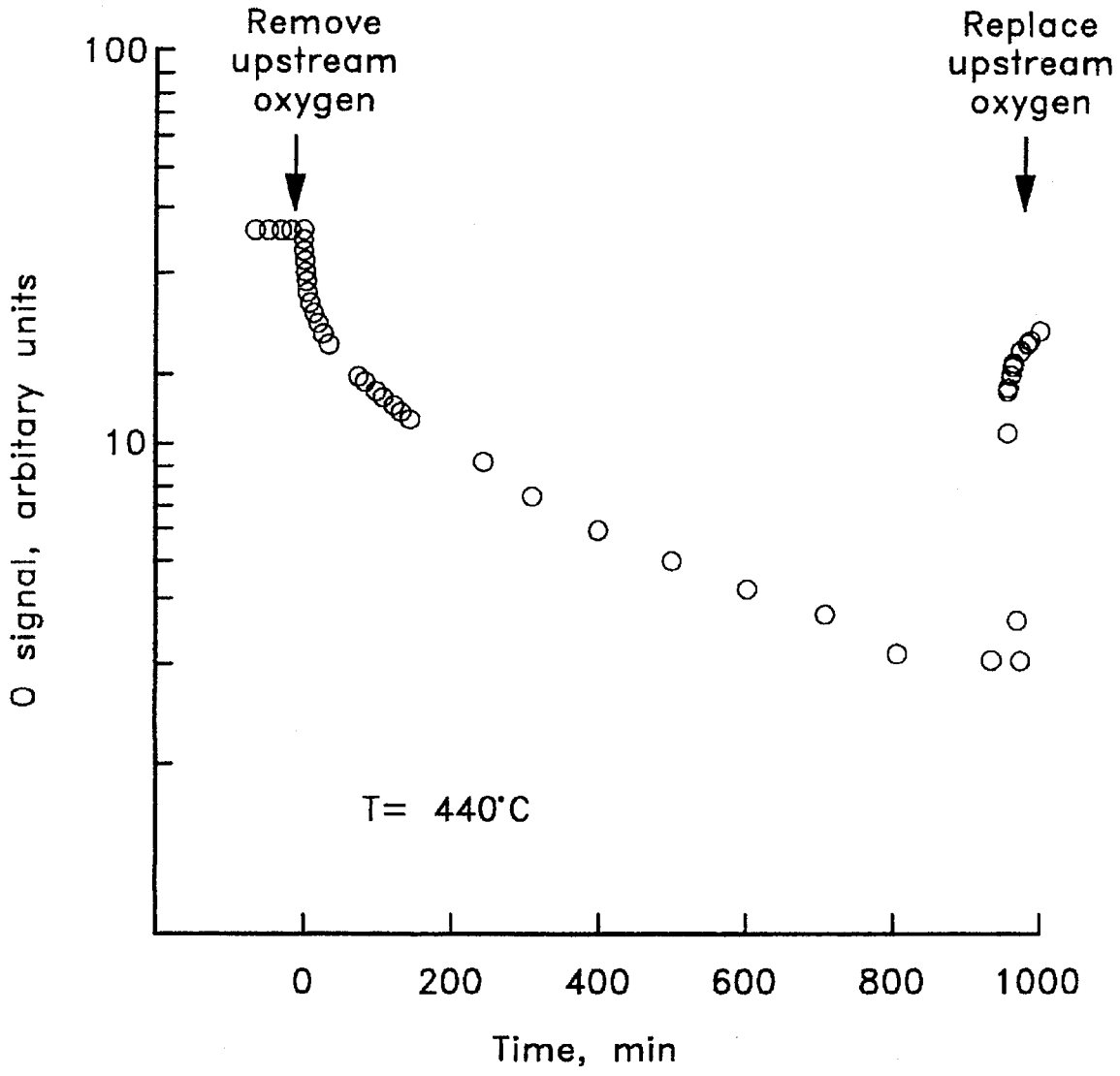
FIG. 7 is a plot of O signal vs. time showing that upstream removal of $O_2$ has an ultimate effect on atomic oxygen flux for a device according to the present invention designed for atomic oxygen production.

The dependence on the source of molecular oxygen upstream is shown in FIG. 7. A steady-state level atomic oxygen flux was first established at an upstream $O_2$ pressures of 100 Torr. The $O_2$ was then pumped out, and the atomic oxygen signal began to decay. After an arbitrary overnight interval of about 16 hours, the 100 Torr of $O_2$ was reapplied to the upstream side, and the original level of atomic oxygen flux was recovered. This confirmed the source of the atomic oxygen and demonstrated the tandem behavior of the two basic mechanisms of oxygen transport and ESD emission. Adjustment of the upstream pressure of $O_2$ is an optional method of controlling the atomic flux, but is not nearly as quick or easy as adjusting the incident electron flux. From FIG. 7 it is seen that the removal of $O_2$ upstream has an ultimate effect on atomic oxygen flux, but over 14 hours is required to decay a factor of 10.

Figure 8:
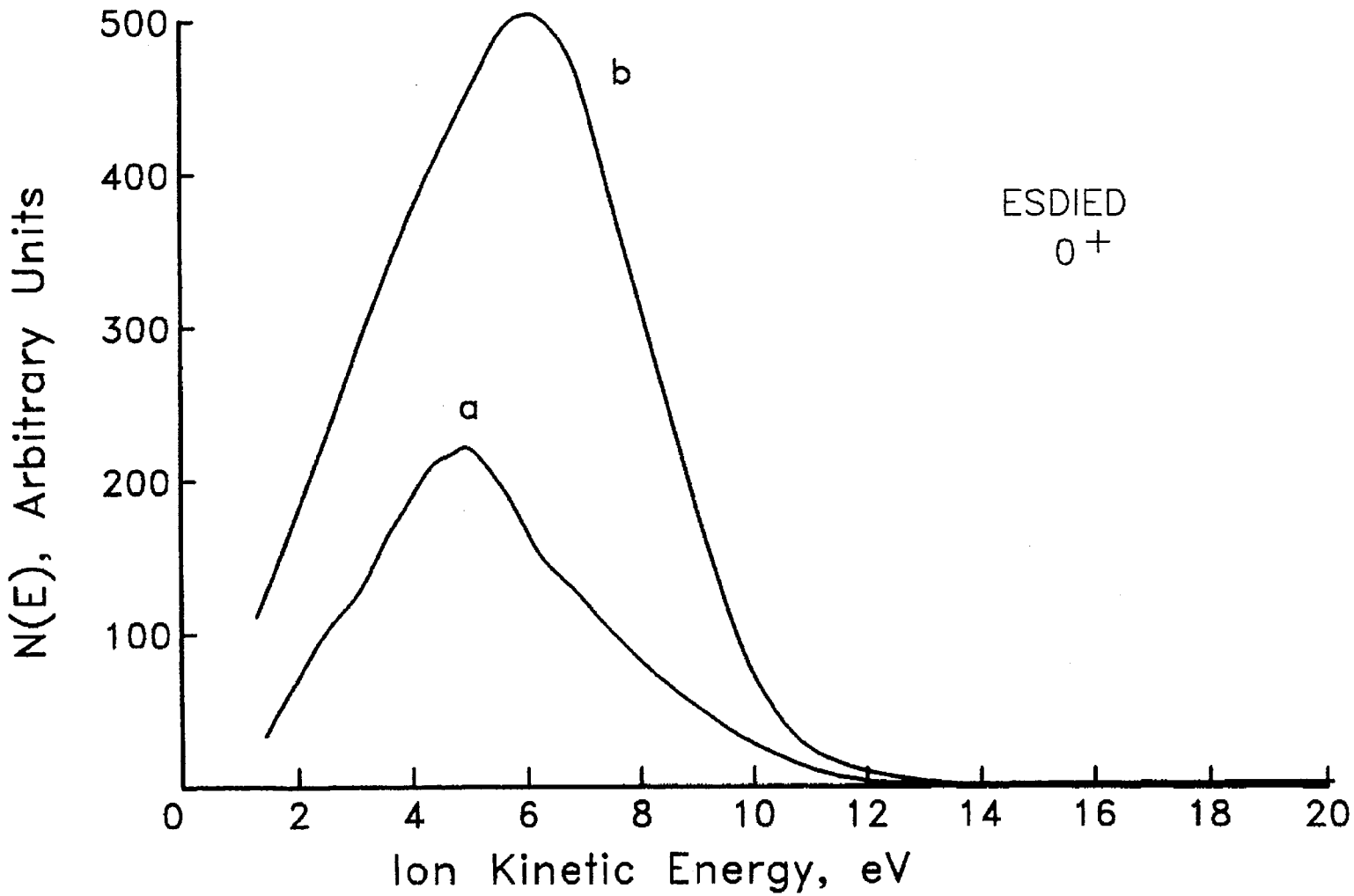
FIG. 8 is a plot showing the ion energy distribution for electron stimulated desorption (ESD) from pure Ag and an Ag 0.5 Zr alloy according to the present invention designed for atomic oxygen production.
Figure 9A:
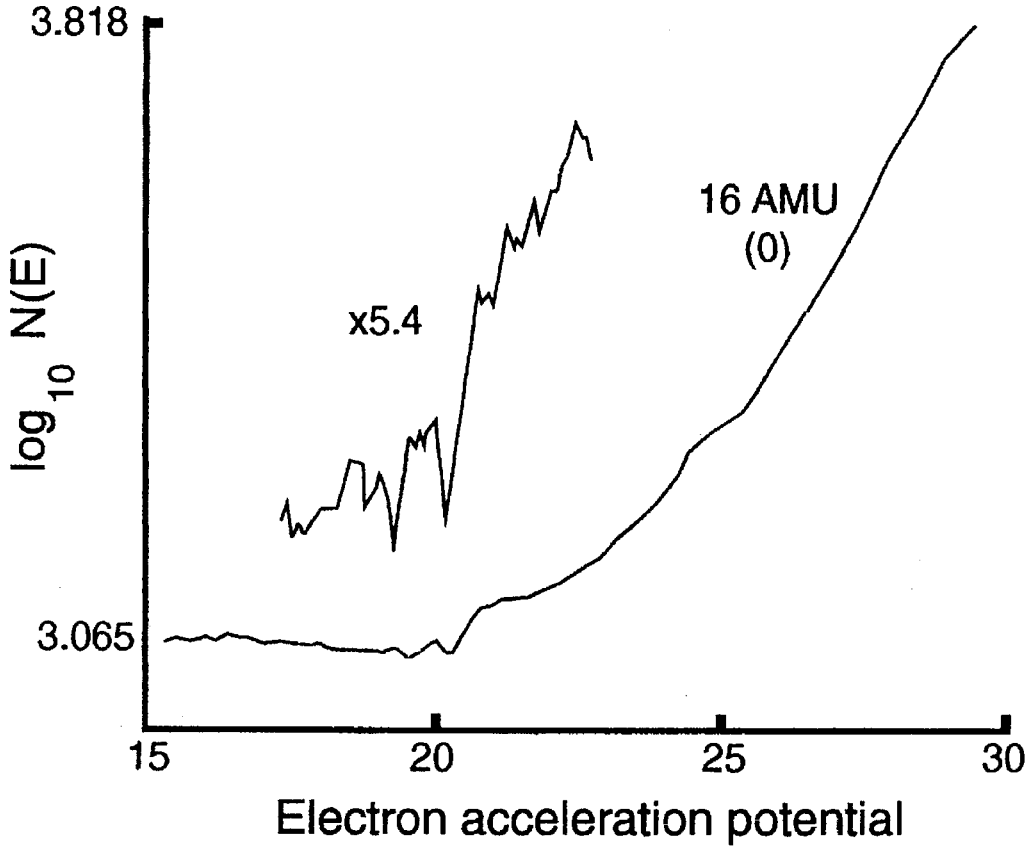
FIG. 9A shows an appearance potential curve for examination of the internal state of O neutrals from a device according to the present invention designed for atomic oxygen production.
Figure 9B:
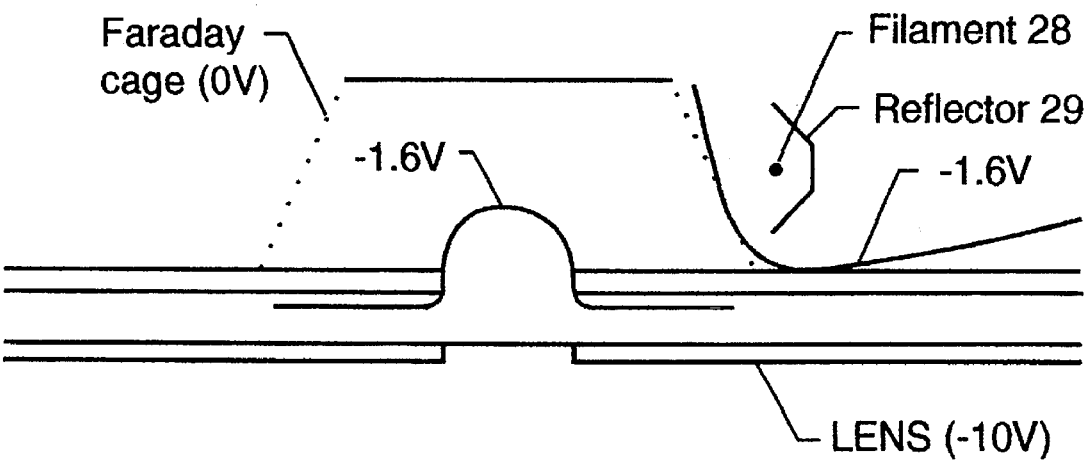
FIG. 9B is a Simion computer simulation for estimation of the field leakage for a device according to the present invention having the specific geometry shown in FIG. 2B.

The ion energy distribution for ESD of oxygen from pure Ag (curve "a") and Ag 0.5 Zr alloy (curve "b") is presented in FIG. 8. An estimate of the neutral distribution was accomplished by varying the lens voltage in the QMS from OV (where the background gases are repelled) to +10 V where the most energetic oxygen neutrals are repelled. It was found that the mean energy for the neutrals is greater than 2 eV. It is suspected that the distribution is quite similar to the ion distribution which is consistent with the hypothesis that the emitted ions by ESD are neutralized by the secondary electron fog with very little loss of kinetic energy.

Figure 10:
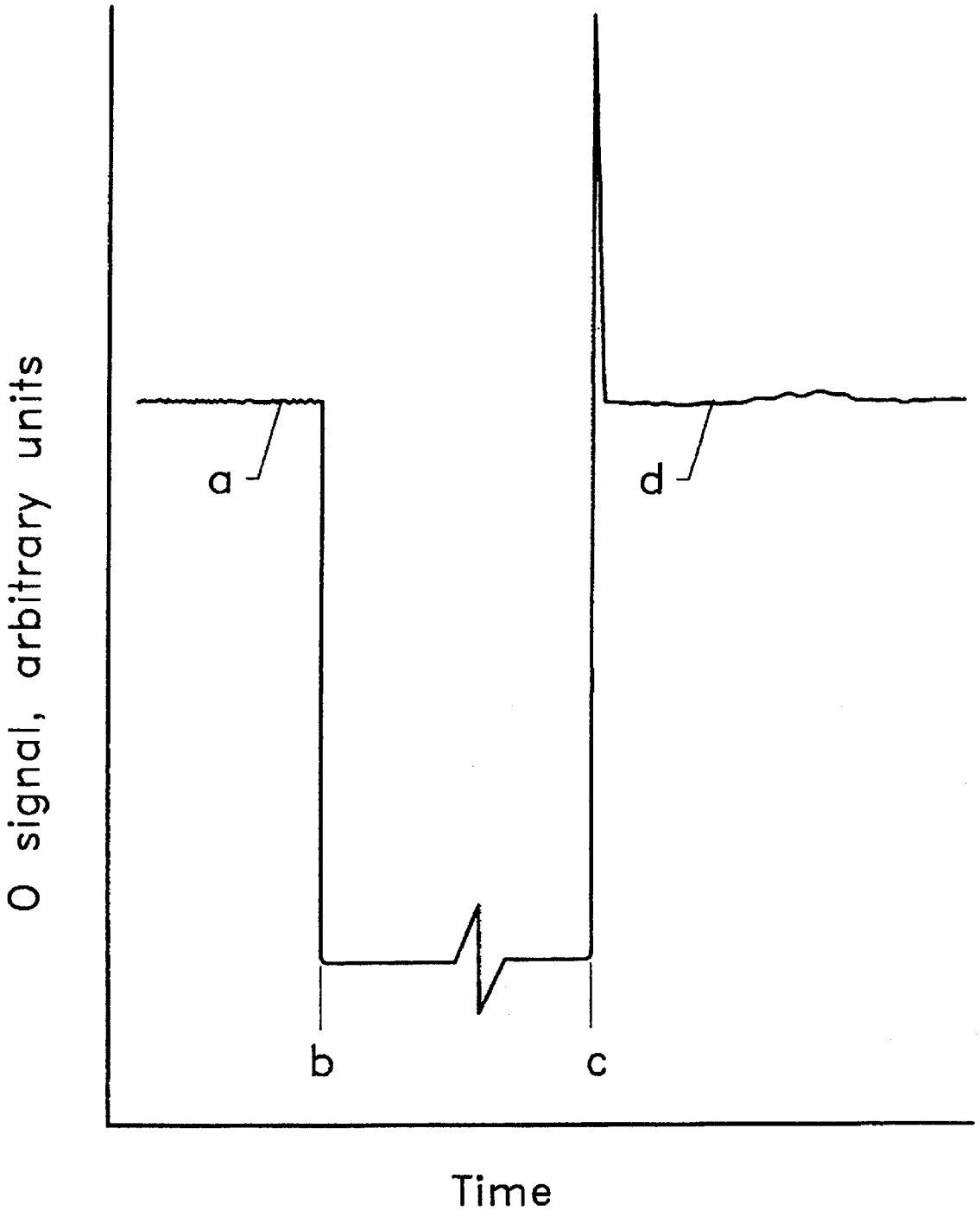
FIG. 10 is a plot showing the initial steady-state atomic oxygen flux for a device according to the present invention designed for atomic oxygen production, followed by removal of the incident electron beam, followed by turning the electron beam on again after five minutes.

It appears quite likely that $1\times10^{14}$ $cm^{-2}s^{-1}$ is achievable before reaching a transport or diffusion limited condition. The cross-over point from ESD control to diffusion control can be easily estimated. FIG. 10 represents the initial steady-state atomic oxygen flux (a), followed by the removal of the incident electron beam (b), and finally the beam being turned back on five minutes later (c). No change in the magnitude of the flux was observed (d), which indicates that the surface coverage was not changed, and therefore, that the hyperthermal oxygen atom generator used is generate this data was operated under conditions that were ESD limited. This is consistent with the data shown in FIG. 6. The transport of atoms through a membrane ($J_T$) at steady-state is given by $$J_T=\frac{2KP_o^{1/2}}{d}=\frac{2K_oP_o^{1/2}}{d}\exp\left[-\frac{E_K}{RT}\right] \quad (3)$$

where

K is the permeability $P_o$ is the normalized upstream pressure (atmospheric fraction).

d is the membrane thickness, $E_K$ is the activation energy for transport,

T is the membrane temperature, and $K_o$ is the membrane permeability.

The flux of ESD or PSD ($J_{ESD}$) emitted neutrals and ions at steady-state is given by $$J_{ESD}=QNJ_{e-} \quad (4)$$

where

Q is the ESD or PSD cross-section

N is the oxygen concentration, and $J_{e-}$ is the incident electron or photon flux.

At steady-state when dθ/dt=0, then $$J_T=J_{ESD} \quad (5)$$

and the temperature where this occurs is given by $$T_c=\frac{E_K}{R}\left[\ln\left(\frac{2K_oP_o^{1/2}}{qNJ_{e-}d}\right)\right]^{-1}. \quad (6)$$

At 5 mA incident e− flux, a value of T=406° C. is determined for the cross-over temperature for the O atom source, which for this membrane thickness (0.038 cm) is acceptable. Increasing the incident electron flux to 50 mA to proportionally increase the atomic oxygen flux to $J_o=1\times10^{14}$ $cm^{-2}s^{-1}$, gives a cross-over temperature of 513° C., which is too close to the temperature for molecular desorption. It then becomes desirable to reduce the membrane thickness to d=13 um (this Ag film thickness requires a support structure) where the cross-over temperature becomes a more acceptable $T_c$=365° C.

Figure 11:
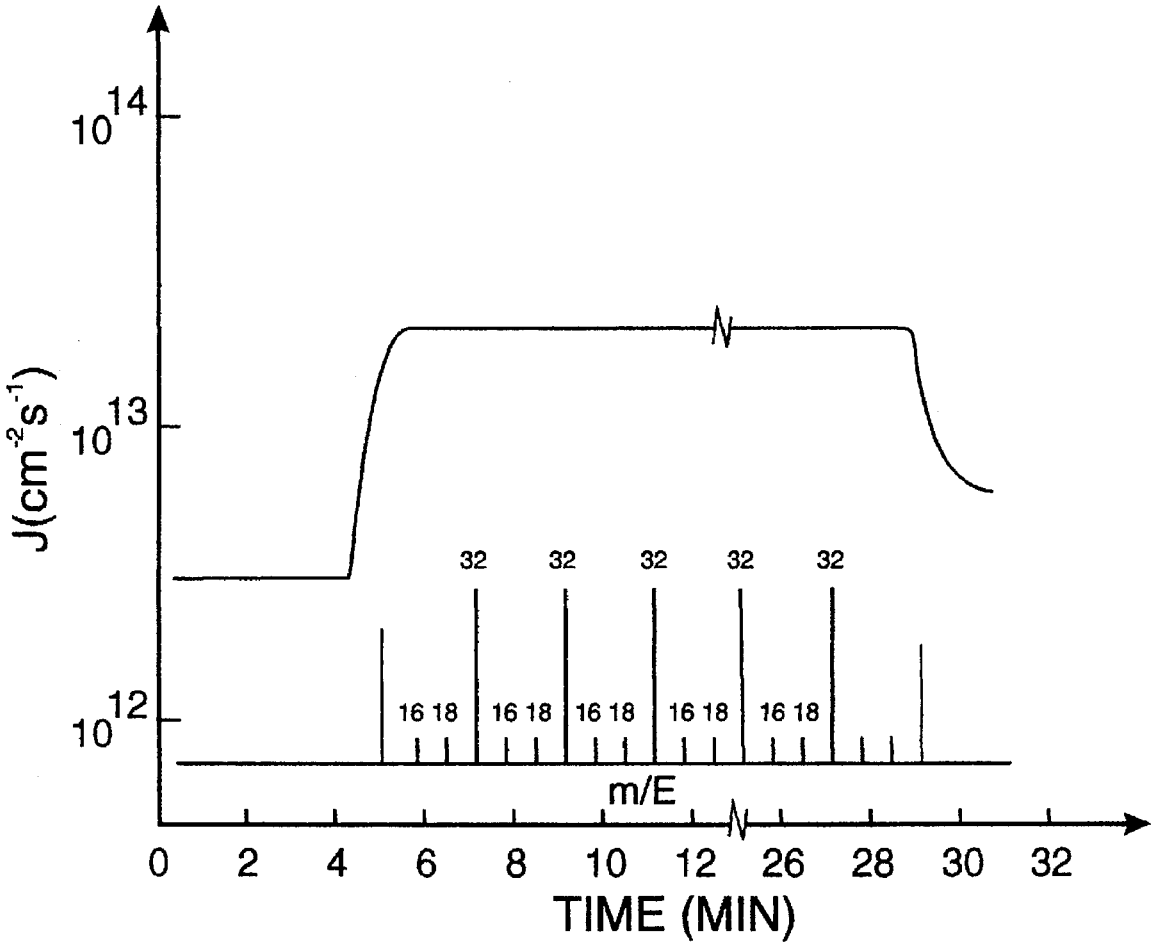
FIG. 11 is a plot showing the advantageous effect of predissociation on transport for the O/Ag system.

FIG. 11 shows the effect of predissociation on the overall transport rate of atoms from the high pressure side of the membrane to the low pressure side. At approximately t=5 minutes, a glow discharge was initiated in the gas species supply. The effect of the glow discharge is to dissociate the gas species into atoms, thereby enhancing the rate at which adsorption and dissolution into the bulk take place. The net effect is nearly an order of magnitude increase in the overall transport as shown in the figure. At t~28 minutes, the glow discharge was turned off and the transport eventually returned to the original level.

As is understood by those of skill in this art, variations and modifications in this detail may be effected without any departure from the spirit and scope of the present invention, as defined in the hereto-appended claims.

We claim:

1. A vacuum compatible hyperthermal atom generator, which comprises:

a membrane having two sides, the membrane having the capability of dissolving atoms into the membrane's bulk;

a first housing in operative association with the first side of the membrane to provide for the exposure of the first side of the membrane to a gas species;

a second housing in operative association with the second side of the membrane for providing a vacuum environment having a pressure of less than $1\times10^{-3}$ Torr on the second side of the membrane; and exciting means for exciting atoms adsorbed on the second side of the membrane to a non-binding state so that a portion from 0% to 100% of atoms adsorbed on the second side of the membrane are released from the second side of the membrane primarily as an atom beam, the exciting means including a cathode in operative association with the membrane, a portion of the cathode being positioned within a volume defined by the projection of the surface of the second side of the membrane in a direction generally perpendicular to the surface of the second side of the membrane at a distance of less than 1-inch from the membrane.

2. A vacuum compatible hyperthermal atom generator, which comprises:

a membrane having two sides, the membrane having the capability of dissolving atoms into the membrane's bulk;

a first housing in operative association with the first side of the membrane to provide for the exposure of the first side of the membrane to a gas species;

a second housing in operative association with the second side of the membrane for providing a vacuum environment having a pressure of less than $1\times10^{-3}$ Torr on the second side of the membrane; and exciting means for exciting atoms adsorbed on the second side of the membrane to a non-binding state so that a portion from 0% to 100% of atoms adsorbed on the second side of the membrane are released from the second side of the membrane primarily as an atom beam, the exciting means including a cathode in operative association with the membrane, at least a portion of the cathode having a zigzag shape.

3. A vacuum compatible hyperthermal atom generator, which comprises:

a membrane having two sides, the membrane having the capability of dissolving atoms into the membrane's bulk;

a first housing in operative association with the first side of the membrane to provide for the exposure of the first side of the membrane to a gas species;

a second housing in operative association with the second side of the membrane for providing a vacuum environment having a pressure of less than $1\times10^{-3}$ Torr on the second side of the membrane;

exciting means for exciting atoms adsorbed on the second side of the membrane to a non-binding state so that a portion from 0% to 100% of atoms adsorbed on the second side of the membrane are released from the second side of the membrane primarily as an atom beam; and a movable shutter in operative association with the second side of the membrane so as to deflect a preselected portion for 0% to 100% of the atomic species released from the second side of the membrane.

4. A vacuum compatible hyperthermal atom generator, which comprises:

a membrane having two sides, the membrane having the capability of dissolving atoms into the membrane's bulk;

a first housing in operative association with the first side of the membrane to provide for the exposure of the first side of the membrane to a gas species;

a second housing in operative association with the second side of the membrane for providing a vacuum environment having a pressure of less than $1\times10^{-3}$ Torr on the second side of the membrane;

exciting means for exciting atoms adsorbed on the second side of the membrane to a non-binding state so that a portion from 0% to 100% of atoms adsorbed on the second side of the membrane are released from the second side of the membrane primarily as an atom beam; and means in operative association with the first housing for predissociation of the gas species.

5. The vacuum compatible hyperthermal atom generator of claim 4 wherein the means for predissociation of the gas species is selected from the group consisting of photon stimulated dissociation, glow discharge stimulated dissociation, RF plasma stimulated dissociation, and microwave stimulated dissociation.

* * * * *